US008459971B2

(12) United States Patent
Muroi et al.

(10) Patent No.: US 8,459,971 B2
(45) Date of Patent: Jun. 11, 2013

(54) SCROLL COMPRESSOR WITH BALANCER AND OIL PASSAGES

(75) Inventors: Shunsuke Muroi, Saitama (JP); Masazumi Naito, Saitama (JP); Tetsuya Nakayasu, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 931 days.

(21) Appl. No.: 12/565,354

(22) Filed: Sep. 23, 2009

(65) Prior Publication Data

US 2010/0080722 A1 Apr. 1, 2010

(30) Foreign Application Priority Data

Sep. 26, 2008 (JP) ..... 2008-247702
Sep. 26, 2008 (JP) ..... 2008-247703

(51) Int. Cl.

| | |
|---|---|
| ***F01C 1/02*** | (2006.01) |
| ***F01C 1/063*** | (2006.01) |
| ***F04C 2/02*** | (2006.01) |
| ***F04C 2/063*** | (2006.01) |
| ***F04C 18/02*** | (2006.01) |
| ***F04C 18/063*** | (2006.01) |

(52) U.S. Cl.
USPC ..... 418/55.6; 418/55.1; 418/55.3

(58) Field of Classification Search
USPC ..... 418/55.1, 55.3, 55.6; 184/6.13, 6.16, 184/6.18
See application file for complete search history.

(56) References Cited

U.S. PATENT DOCUMENTS

| | | | | |
|---|---|---|---|---|
| 4,734,020 | A * | 3/1988 | Inaba et al. | 418/55.6 |
| 4,824,346 | A * | 4/1989 | Hiraga et al. | 418/55.5 |
| 4,874,302 | A * | 10/1989 | Kobayashi et al. | 415/55.3 |
| 5,040,958 | A * | 8/1991 | Arata et al. | 418/55.5 |
| 6,109,897 | A * | 8/2000 | Haga | 418/55.1 |
| 7,121,816 | B2 * | 10/2006 | Matsushima | 418/55.1 |
| 7,207,788 | B2 * | 4/2007 | Sato | 418/55.6 |
| 2007/0178001 | A1 * | 8/2007 | Minekawa et al. | 418/55.1 |
| 2007/0231175 | A1 * | 10/2007 | Suefuji et al. | 418/55.3 |
| 2007/0292293 | A1 * | 12/2007 | Fujita et al. | 418/55.2 |

FOREIGN PATENT DOCUMENTS

| | | | |
|---|---|---|---|
| JP | 7-54784 | A | 2/1995 |
| JP | 2002-89473 | A | 3/2002 |

* cited by examiner

*Primary Examiner* — Mary A Davis
(74) *Attorney, Agent, or Firm* — Birch, Stewart, Kolasch & Birch, LLP

(57) ABSTRACT

A scroll compressor including a stationary scroll formed with a scroll wrap, an orbiting scroll formed with a scroll wrap, a rotating shaft for putting the orbiting scroll into an orbiting motion, a rotating bearing for rotatably supporting the rotating shaft on the stationary scroll, an orbiting scroll bearing provided at an eccentric shaft portion of the rotating shaft and operative to orbitably support a central portion of the orbiting scroll. A coupling transmits a torque of a driving shaft to the rotating shaft. The scroll compressor is compact based on the layout of a balancer. The orbiting scroll bearing is disposed at a central portion of the rotating shaft, and the coupling is provided with the balancer. The stationary scroll may be provided with ribs being formed therein with an oil passage for connection between a central oil passage formed in the rotating shaft and the exterior.

12 Claims, 9 Drawing Sheets

SCROLL COMPRESSOR WITH BALANCER AND OIL PASSAGES

CROSS-REFERENCE TO RELATED APPLICATIONS

The present application claims priority under 35 USC 119 to Japanese Patent Application No. 2008-247702 filed on Sep. 26, 2008 and Japanese Patent Application No. 2008-247703 filed on Sep. 26, 2008 the entire contents of which are hereby incorporated by reference.

BACKGROUND OF THE INVENTION

1. Field of the Invention

The present invention relates to a scroll compressor, and particularly to the layout position of a balancer for balancing a centrifugal force generated by an eccentric shaft portion of a rotating shaft and an orbiting scroll, and to a lubricating oil passage extending toward a needle bearing for eccentrically driving a hub portion of the orbiting scroll. In addition, the present invention relates to a scroll compressor used in connected with an engine, and particularly to an oil passage for connection between the exterior of the scroll compressor and a central oil passage formed in a rotating shaft.

2. Description of Background Art

A configuration wherein a needle bearing for supporting a hub portion of an orbiting scroll is disposed at a central portion of a rotating shaft in a scroll compressor, and balancers are disposed on both sides of the needle bearing are disclosed, for example, in Japanese Patent Laid-open No. 2002-89473 (FIG. 1). In this configuration, the balancers are provided on the inside of the orbiting scroll, so that they are located close to the rotating shaft and the balancers are enlarged in size in the axial direction. With this configuration, the formation of an oil passage or passages is complicated in the case of attempting to externally supply the needle bearing with a lubricating oil.

An example of an oil passage for connection between the exterior of a scroll compressor having a rotating shaft set vertical and a central oil passage formed in the rotating shaft is shown, for example, in Japanese Patent Laid-open No. Hei 7-54784 (FIG. 1). However, the scroll compressor pertaining to the present invention is a scroll compressor having a horizontal rotating shaft which is used in connection with an engine having a horizontal crankshaft. Therefore, an oil passage applied to a vertical rotating shaft as in the above-mentioned document cannot be adopted in the scroll compressor pertaining to the present invention.

There is a need to provide a simple structure by which an oil passage for externally supplying a lubricating oil to each bearing inside a scroll compressor can be provided without complicating the shape of the scroll compressor.

SUMMARY AND OBJECTS OF THE INVENTION

It is an object of an embodiment of the present invention to render a scroll compressor compact and to facilitate the supply of a lubricating oil by improving layout of a balancer(s) and layout of an oil passage(s).

According to an embodiment of the present invention, a scroll compressor includes:

a stationary scroll formed with a scroll wrap;

an orbiting scroll formed with a scroll wrap;

a rotating shaft for putting the orbiting scroll into an orbiting motion;

a rotating bearing for rotatably supporting the rotating shaft on the stationary scroll;

an orbiting scroll bearing which is provided at an eccentric shaft portion of the rotating shaft and by which a central portion of the orbiting scroll is orbitably supported; and a coupling for transmitting a torque of a driving shaft to the rotating shaft;

wherein the orbiting scroll bearing is disposed at a central portion of the rotating shaft, and the coupling is provided with a balancer.

According to an embodiment of the present invention, a scroll compressor includes positioning members for restricting an axial thrust of the orbiting scroll bearing that are disposed on both sides of the orbiting scroll bearing, and an oil passage provided at an axis of the rotating shaft communicates with the positioning members.

According to an embodiment of the present invention, the balancer is formed in an annular shape, and is fitted on an outer periphery of the coupling.

According to an embodiment of the present invention, the eccentric shaft portion is provided with a lightening hole along the axial direction thereof, and the balancer is provided on the opposite side of the rotating shaft from the eccentric shaft portion.

According to an embodiment of the present invention, the balancer is disposed on the outside of the stationary scroll. Therefore, the balancer can be disposed to be spaced from the rotating shaft. Further, since the balancer is provided to be integral with the coupling, the layout of the compressor including the balancer and the coupling can be made compact.

According to an embodiment of the present invention, the thrust of the orbiting scroll bearing can be easily restricted by the positioning members. In addition, by the structure in which the oil passage provided at the axis of the rotating shaft communicates with the positioning members, an easy supply of a lubricating oil can be achieved.

According to an embodiment of the present invention, the positioning of the balancer relative to the coupling is facilitated, and the rotating mass of the rotating shaft can be increased.

According to an embodiment of the present invention, the rotating shaft and the balancer can be reduced in weight.

According to an embodiment of the present invention, a scroll compressor includes:

a stationary scroll formed with a scroll wrap;

an orbiting scroll formed with a scroll wrap;

a rotating shaft for putting the orbiting scroll into an orbiting motion;

a rotating bearing for rotatably supporting the rotating shaft on the stationary scroll; and an orbiting scroll bearing which is provided at an eccentric shaft portion of the rotating shaft and by which a central portion of the orbiting scroll is orbitably supported;

wherein the stationary scroll is provided at an outside surface thereof with a rib extending radially from a support portion of the rotating bearing, and the rib is formed therein with an oil passage through which a central oil passage formed in the rotating shaft is connected to the exterior.

According to an embodiment of the present invention, a space is provided surrounded by the stationary scroll, the rotating shaft, the rotating bearing interposed between the stationary scroll and the rotating shaft. An oil seal is provided at one side surface of the rotating bearing interposed between the stationary scroll and the rotating shaft. The space communicates on one side thereof with the central oil passage in the rotating shaft. In addition, the space communicates on the other side thereof with the oil passage formed in the rib of the stationary scroll. A set plate for restricting the position of the rotating bearing in an axial direction is further provided at the other side surface of the rotating bearing, and an oil seal for covering the other side surface of the rotating bearing is held by the set plate.

According to an embodiment of the present invention, the scroll compressor is connected to an engine;

the rotating shaft of the scroll compressor is connected to a crankshaft of the engine through a coupling;

the central oil passage in the rotating shaft opens at a shaft end on the side opposite to the engine connection side; and a lubricating oil is supplied to the shaft end opening of the central oil passage in the rotating shaft through the oil passage formed in the rib of the stationary scroll on the side opposite to the engine connection side.

According to an embodiment of the present invention, the oil passage for connection between the central oil passage in the rotating shaft and the exterior is formed by utilizing the rib formed in the stationary scroll. Therefore, the oil passage for supplying a lubricating oil to the orbiting scroll bearing and the like can be easily formed, without complicating the shape of the stationary scroll.

According to an embodiment of the present invention, the space defined by the stationary scroll, the rotating shaft, the rotating bearing, and the oil seal provided at one side surface of the rotating bearing is utilized as a lubricating oil passage, so that the rotating bearing is lubricated. In addition, the rotating bearing is positioned assuredly by the set plate. Moreover, by the structure in which the oil seal at the other side surface of the rotating bearing is held by the set plate, leakage of the lubricating oil from the rotating bearing can be prevented using a simple configuration.

According to an embodiment of the present invention, the oil passage opening in the circumferential direction of the rotating shaft is formed, in view of the fact that in the case where the scroll compressor and the engine are connected to each other through a coupling, it is difficult to form an oil passage, opening in the axial direction, at a shaft end on the engine side of the rotating shaft. When it is attempted to use this oil passage so as to supply a lubricating oil into the central oil passage in the rotating shaft, it is necessary to raise the oil pressure so as to overcome a centrifugal force exerted from the rotating shaft being rotated. Where the central oil passage is opened at a shaft end on the side opposite to the engine connection side and the lubricating oil is supplied into the central oil passage through the shaft end opening. However, no centrifugal force is exerted on the lubricating oil during the supply. Therefore, the lubricating oil can be supplied into the central oil passage, without complicating the structure and at a low oil pressure.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
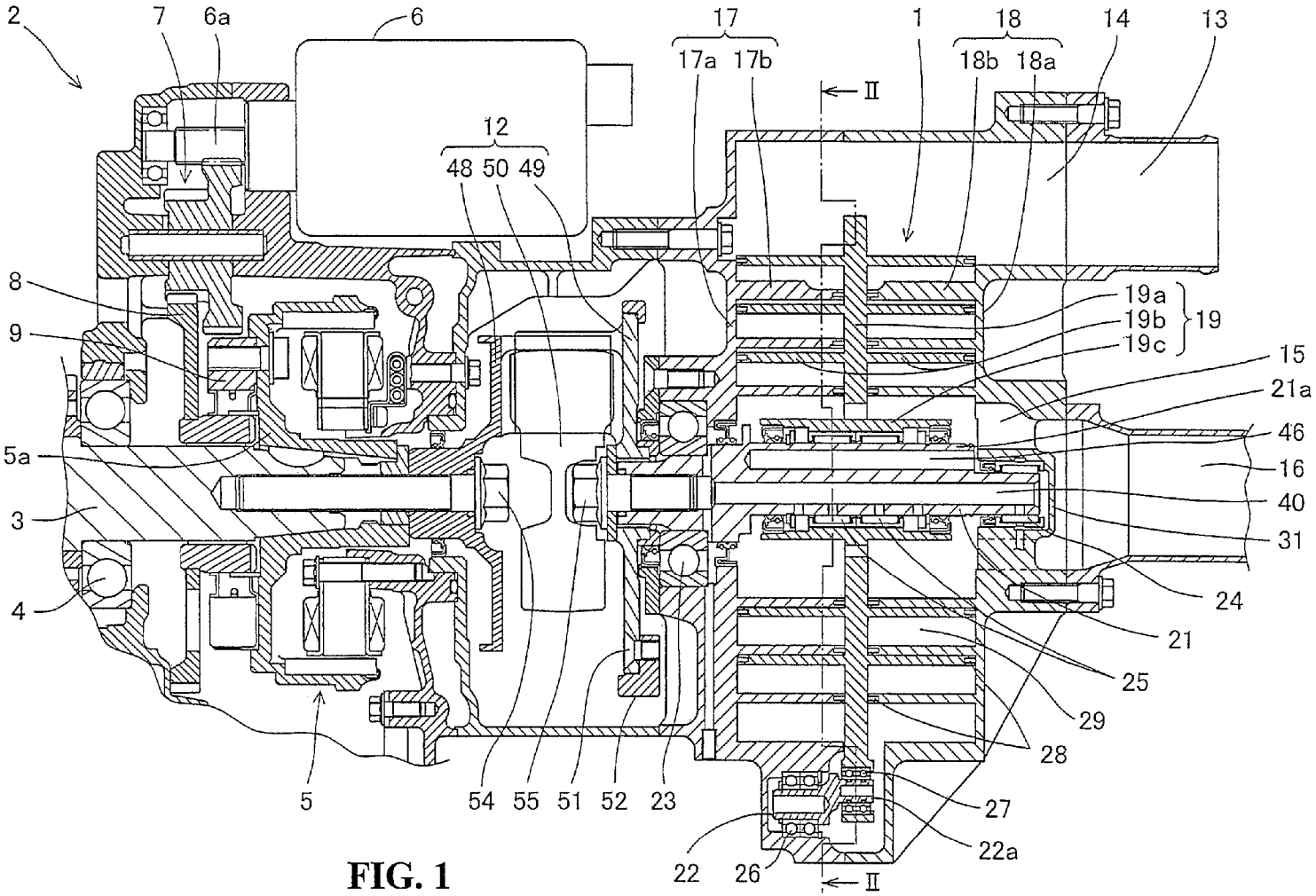
FIG. 1 is a longitudinal sectional view of a rear portion of a power unit in which a scroll compressor according to a first embodiment of the present invention is provided.

FIG. 1 is a longitudinal sectional view of a rear portion of a power unit 2 in which a scroll compressor 1 according to a first embodiment of the present invention is provided at a rear portion of an engine of a vehicle. The vehicle is a four-wheel saddle ride type vehicle, wherein a crankshaft 3 of the engine is provided in parallel to the running direction of the vehicle. The crankshaft 3 is rotatably supported by a ball bearing 4. An AC generator 5 is provided at a rear portion of the crankshaft 3. In addition, an output shaft (not shown) of the engine is also parallel to the running direction of the vehicle, and rear wheels are driven by a drive shaft extended rearwards through a universal joint. A starter motor 6 is mounted at a position on the upper side of the crankshaft 3, and a driving force of a rotating shaft 6*a* of the starter motor 6 is transmitted through a gear train 7, and transmitted to the crankshaft 3 through a starting driven gear 8, a one-way clutch 9 and an AC generator rotor 5*a* which are provided around the crankshaft 3.

The scroll compressor 1 is connected to the rear end of the crankshaft 3 through a coupling 12. The scroll compressor 1 is a device by which cleaned air from an air cleaner is taken in through an intake pipe 13 and an intake port 14 into the inside of the device (scroll compressor 1), is thereby compressed, and the thus compressed clean air is fed out to a throttle body of the power unit 2 through a discharge port 15 and a discharge pipe 16 which are provided at a central portion. In other words, the scroll compressor 1 is used as a supercharger.

A shell body of the scroll compressor 1 is composed of a pair of stationary scrolls 17, 18. An orbiting scroll 19 is mounted between the stationary scrolls 17, 18 facing each other. The stationary scroll 17 on the front side is fixed to a fixing portion of the power unit 2, and the stationary scroll 18 on the rear side is fixed to the front-side stationary scroll 17. The front-side stationary scroll 17 is composed of a flat plate portion 17*a*, and a scroll wrap (spiral blade) 17*b* erected from one side of the flat plate portion 17*a*. Similarly, the rear-side stationary scroll 18 is composed of a flat plate portion 18*a*, and a scroll wrap 18*b* erected from one side of the flat plate portion 18*a*. The pair of stationary scrolls 17 and 18 face each other, with their scroll wraps 17*b* and 18*b* on the inner side. The flat plate portions 17*a* and 18*a* on the outer sides function also as a housing of the scroll compressor 1. The orbiting scroll 19 is provided with scroll wraps 19*b* on the front and rear sides of a flat plate portion 19*a* thereof, and is provided with a boss portion 19*c* at a central portion thereof. The scroll wraps 19*b* of the orbiting scroll 19 are assembled so as to mesh with the scroll wraps 17*b*, 18*b* of the stationary scrolls 17, 18 and to be capable of an orbiting motion.

The scroll compressor 1 is provided with a single first rotating shaft 21 at a central portion thereof, and with three second rotating shafts 22 in a peripheral portion thereof. The rotating shafts 21, 22 have eccentric shaft portions 21*a*, 22*a* parallel to the rotating shafts 21, 22, respectively. The first rotating shaft 21 is rotatably supported by a ball bearing 23 and a needle bearing 24. The eccentric shaft portion 21*a* of the first rotating shaft 21 makes contact with the inner periphery of the boss portion 19*c* at the center of the orbiting scroll 19 through tandem type needle bearings 25, so as to support the orbiting scroll 19 and to eccentrically drive the latter. The second rotating shaft 22 is rotatably supported on the front-side stationary scroll 17 through tandem type ball bearings 26. The eccentric shaft portion 22*a* of the second rotating shaft 22 is eccentrically driven with an outer periphery portion of the orbiting scroll 19 supported by the function of tandem type ball bearing 27. By the functions of the first rotating shaft 21 and the second rotating shaft 22, the orbiting scroll 19 is made to orbit around the rotational axis of the first rotating shaft 21. In other words, the orbiting scroll 19 is made to revolve without rotating. In addition, a central oil passage 40 is bored in the first rotating shaft 21, whereas a lightening hole 46 is bored in the eccentric shaft portion 21*a*.

Figure 2:
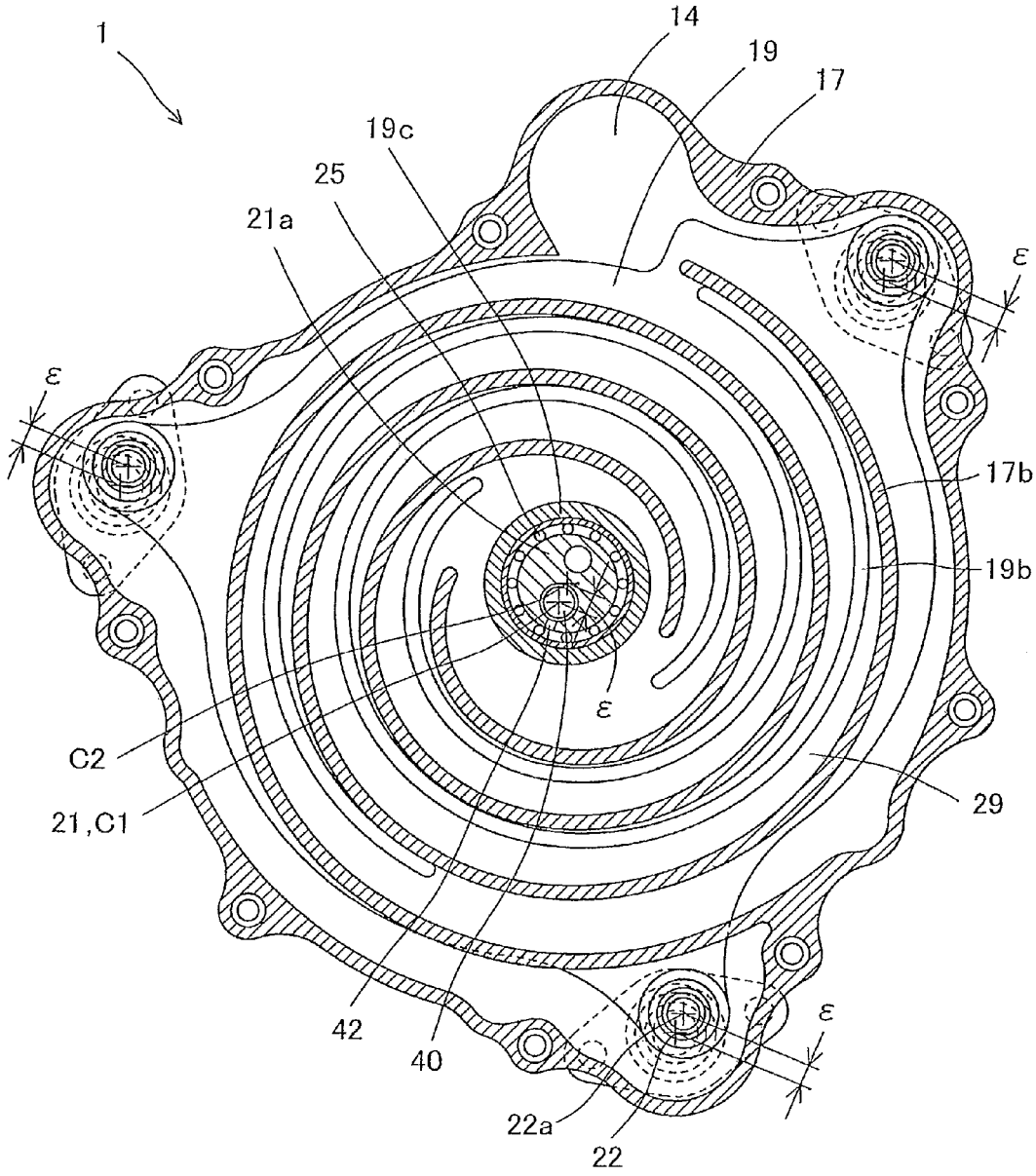
FIG. 2 is a sectional view taken along line II-II of FIG. 1.

FIG. 2 is a sectional view taken alone line II-II of FIG. 1. An intake port 14 is provided at an upper portion of the scroll compressor 1. FIG. 2 illustrates the condition wherein the scroll wrap 17*b* of the front-side stationary scroll 17 and the scroll wrap 19*b* of the orbiting scroll 19 are meshing with each other. In FIG. 2, the first rotating shaft 21 penetrating the center of the scroll compressor 1. The eccentric shaft portion 21*a* shown in the figure is penetrating the boss portion 19*c* of the orbiting scroll 19, with the needle bearings 25 therebetween. The center C2 of the eccentric shaft portion 21*a* of the first rotating shaft 21 is spaced from the rotational center C1 of the first rotating shaft 21 by an eccentricity amount $\epsilon$. The eccentric shaft portion 22*a* of each of the second rotating shafts 22 provided in the peripheral portion of the scroll compressor 1, also, is located eccentrically with an eccentricity amount c.

Each of the stationary scroll wrap 17*b* and the orbiting scroll wrap 19*b* is formed in the shape of an involute curve, and makes contact with the flat plate portion 19*a*, 17*a* of the mating scroll through a seal member 28 (FIG. 1) provided at an edge portion of the wrap thereof. When the orbiting scroll 19 is put into an orbiting motion by the functions of the first rotating shaft 21 at the central portion and the three second rotating shafts 22 in the peripheral portion, compression chambers 29 formed in the state of being surrounded by the stationary scroll wrap 17*b* and the orbiting scroll wrap 19*b* and the opposed scroll flat plate portions 17*a* and 19*a* are sequentially moved from the outer periphery toward the center of the scroll compressor 1 while being decreased in internal volume. Air taken into the compression chamber 29 at the outermost periphery is gradually compressed, to finally reach a high pressure at the central portion, before being discharged via the discharge port 15 (see FIGS. 1 and 3) at the central portion of the rear-side stationary scroll 18.

Figure 3:
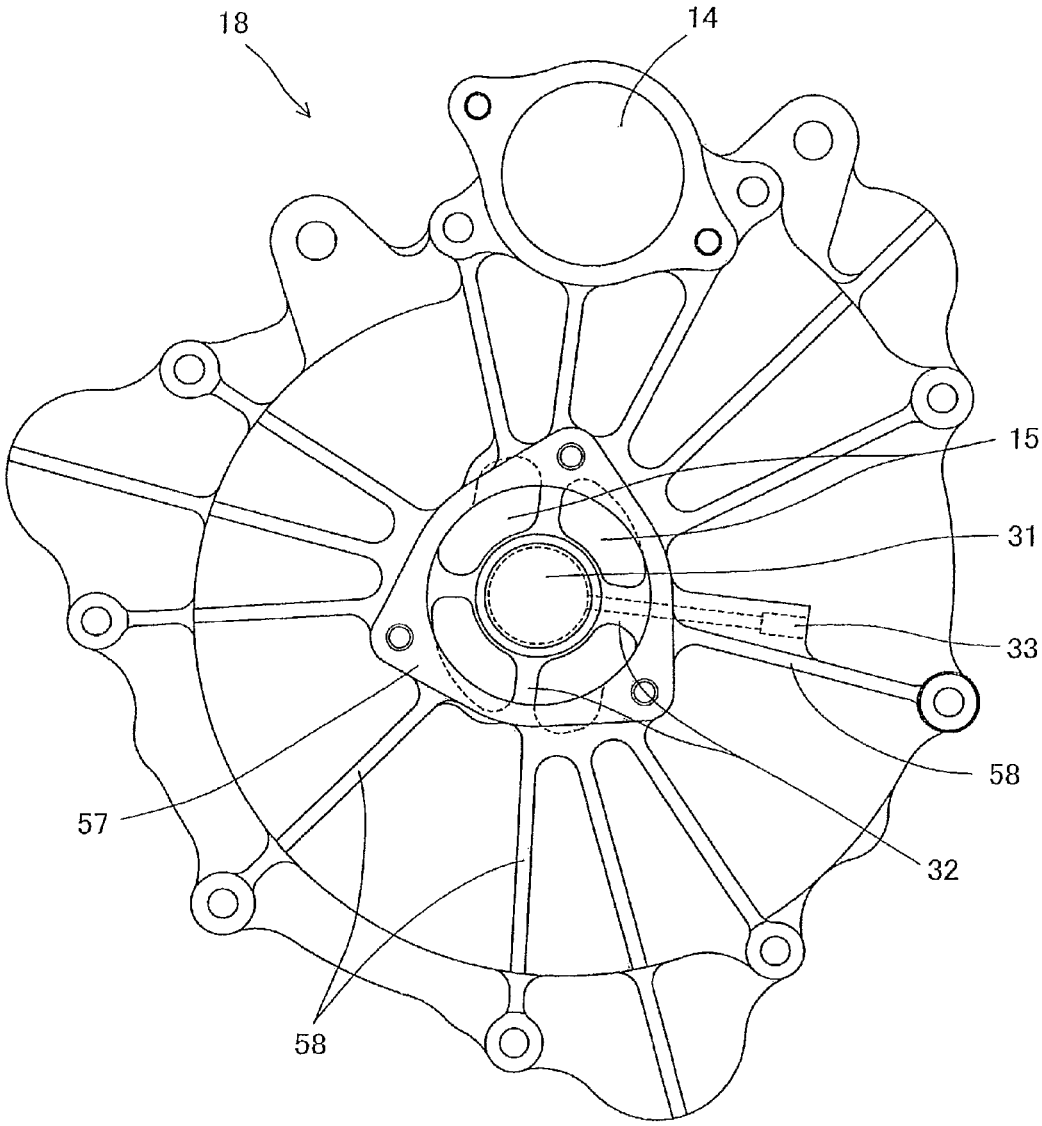
FIG. 3 is a rear view of a rear-side stationary scroll.

FIG. 3 is a rear view of the rear-side stationary scroll 18. The intake port 14 is seen at an upper portion. In a central portion, a rear portion bearing portion 31 where a rear portion of the first rotating shaft 21 is supported through the needle bearing 24 (FIG. 1) is supported by four struts 32. Each space between the struts 32, 32 serves as the discharge port 15. A plurality of ribs 58 are provided to extend radially from the boss portion 57 at the center toward the peripheral portion. One 32 of the four struts 32 and one rib 58 continuous with the one strut 32 are formed to be large in cross section, and are provided therein with a rib-strut portion oil passage 33 for supplying the rear portion bearing portion 31 with a lubricating oil externally. The destinations of supply of the lubricating oil will be described later.

Figure 4:
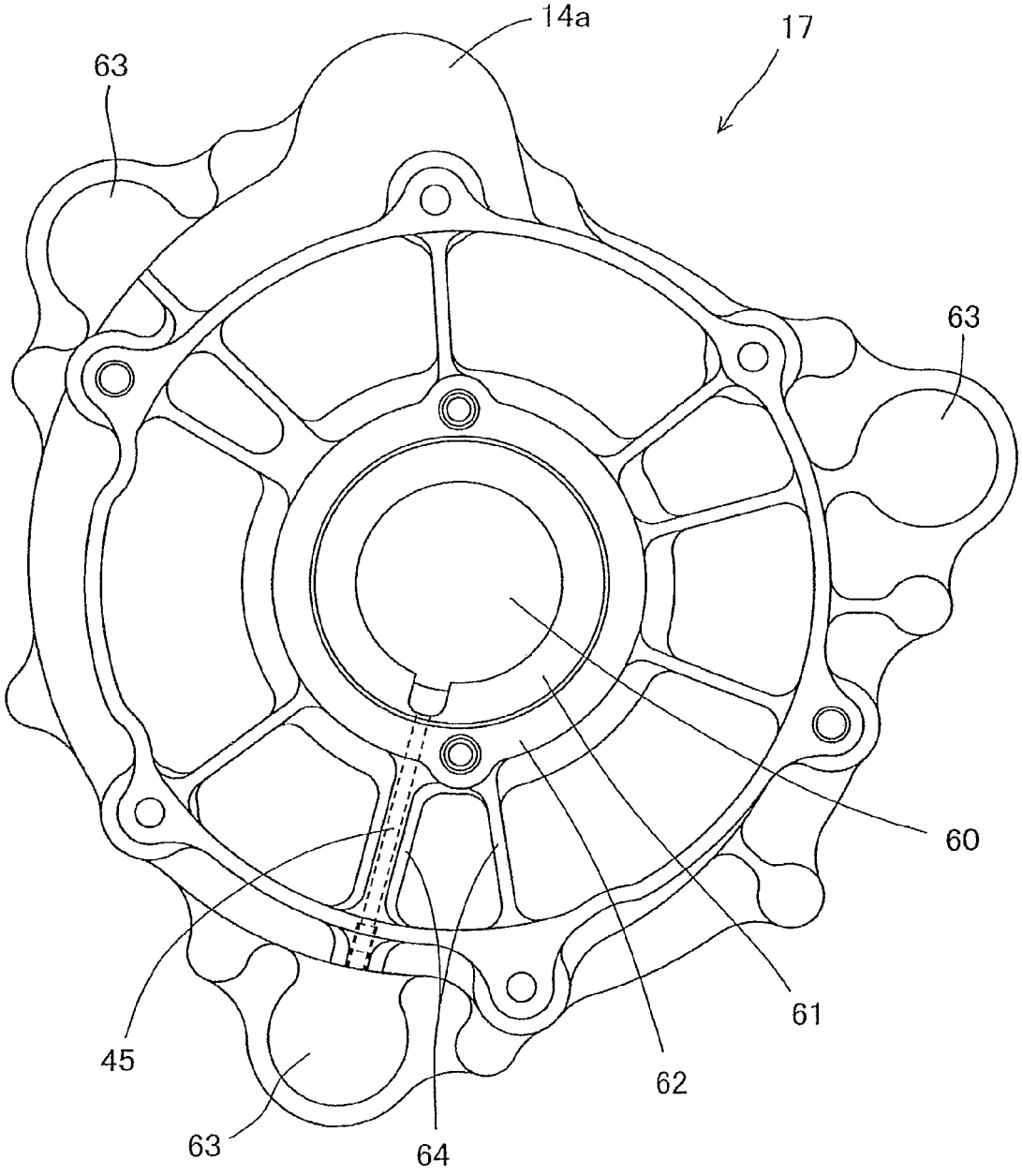
FIG. 4 is a front view of a front-side stationary scroll.

FIG. 4 is a front view of the front-side stationary scroll 17. A terminal end portion 14*a* of the intake port 14 is seen at an upper portion. In a central portion, there are provided a first rotating shaft passing hole 60, a bearing portion 61 for supporting the first rotating shaft 21 by the ball bearing 23, and a boss portion 62 in the periphery thereof. Second rotating shaft support portions 63 are provided at three positions in the periphery. A plurality of ribs 64 are provided to extend radially from the boss portion 62 toward the peripheral portion. One of the ribs 64 is formed to be large in cross section, and the one rib 64 is provided therein with a rib portion oil passage 45 extending from an outer peripheral portion to reach the bearing portion 61. The oil passage 45 is an oil passage for discharging a surplus portion of the lubricating oil supplied into the central oil passage 40.

Figure 5:
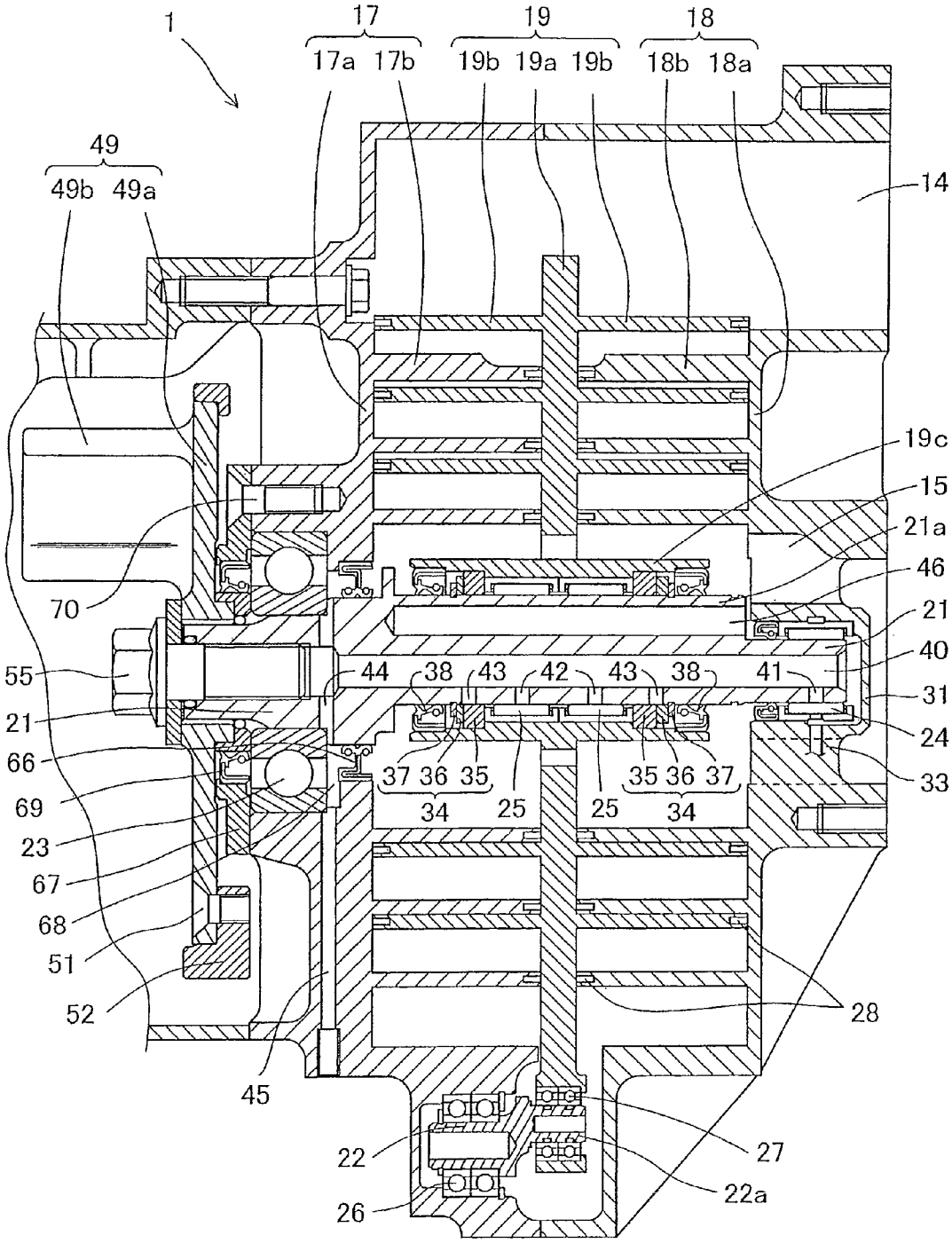
FIG. 5 is an enlarged longitudinal sectional view of the scroll compressor.

FIG. 5 is an enlarged longitudinal sectional view of the scroll compressor 1. At the eccentric shaft portion 21*a* of the first rotating shaft 21, tandem type needle bearings 25 are provided for eccentrically driving the cylindrical boss portion 19*c* of the orbiting scroll 19. In addition, as positioning members 34 for the needle bearings 25, copper bushes 35 and shims 36 are mounted on the front and rear sides of the needle bearings 25, and circlips 37 are provided on the front and rear sides thereof, whereby the needle bearings 25 are inhibited from being moved by thrusts arising from pressure variations in the scroll compressor 1. Oil seals 38 are mounted respectively on the axially outer sides of the front and rear circlips 37, so as to prevent leakage of the lubricating oil.

The rear portion bearing portion 31 at the rear end of the first rotating shaft 21 is provided therein with the rib-strut portion oil passage 33 which has been shown in FIG. 3. The lubricating oil supplied through the rib-strut portion oil passage 33 flows around the outside of the needle bearing 24 to reach a rear end portion of the first rotating shaft 21, and flows into the central oil passage 40 in the first rotating shaft 21. The first rotating shaft 21 is provided therein with an oil passage 41 leading to the first rotating shaft rear portion needle bearing 24, oil passages 42 leading to the first rotating shaft eccentric shaft portion needle bearings 25, oil passages 43 leading to the first rotating shaft eccentric shaft portion needle bearing positioning members 34, and an oil passage 44 leading to the first rotating shaft front portion ball bearing 23, for lubricating the relevant portions, respectively. A surplus portion of the lubricating oil is discharged through the rib portion oil passage 45 provided in one of the ribs at the outside surface of the front-side stationary scroll 17. The eccentric shaft portion 21*a* has the lightening hole 46 bored therein.

An oil seal 66 is provided on the stationary scroll 17 side of the ball bearing 23, and there is formed a space 68 which is surrounded by the stationary scroll 17, the rotating shaft 21, the ball bearing 23, and the oil seal 66. On the rotating shaft 21 side, the space 68 communicates with the oil passage 44 leading to the first rotating shaft front portion ball bearing 23; on the outer periphery side, the space 68 communicates with the rib portion oil passage 45. On the driven coupler 49 side of the ball bearing 23, a set plate 67 for restricting the position of the ball bearing 23 in the axial direction is mounted through a mounting bolt 70. An oil seal 69 for covering the driven coupler 49 side of the ball bearing 23 is held by the set plate 67. While the space 68 serves as a passage for the lubricating oil, leakage of the lubricating oil therefrom is prevented, since the oil seals 66 and 69 are provided respectively on both sides of the ball bearing 23.

Figure 6:
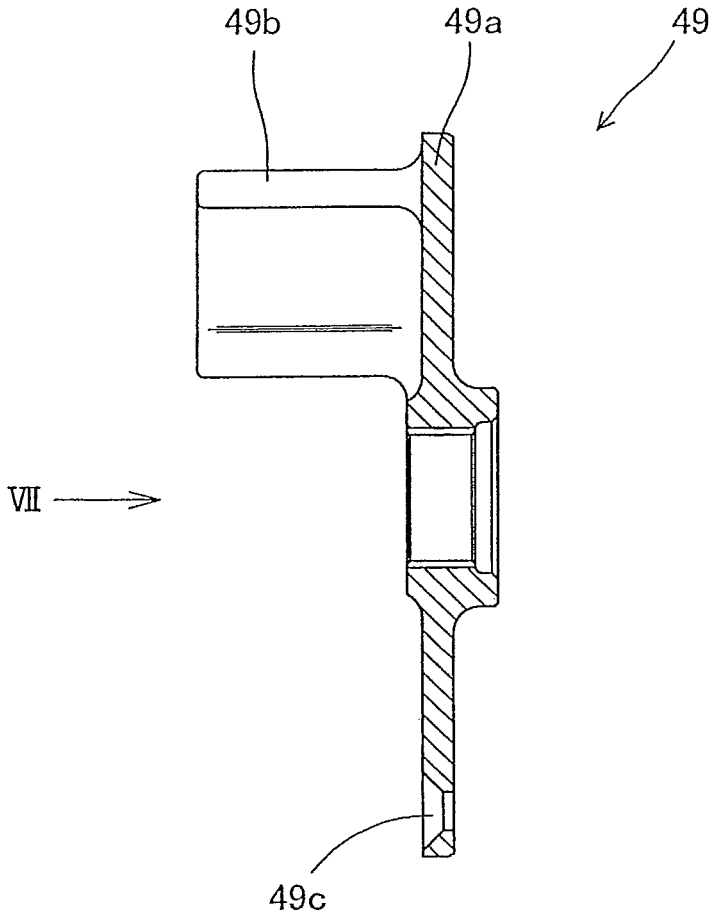
FIG. 6 is a sectional view of a driven coupler.
Figure 7:
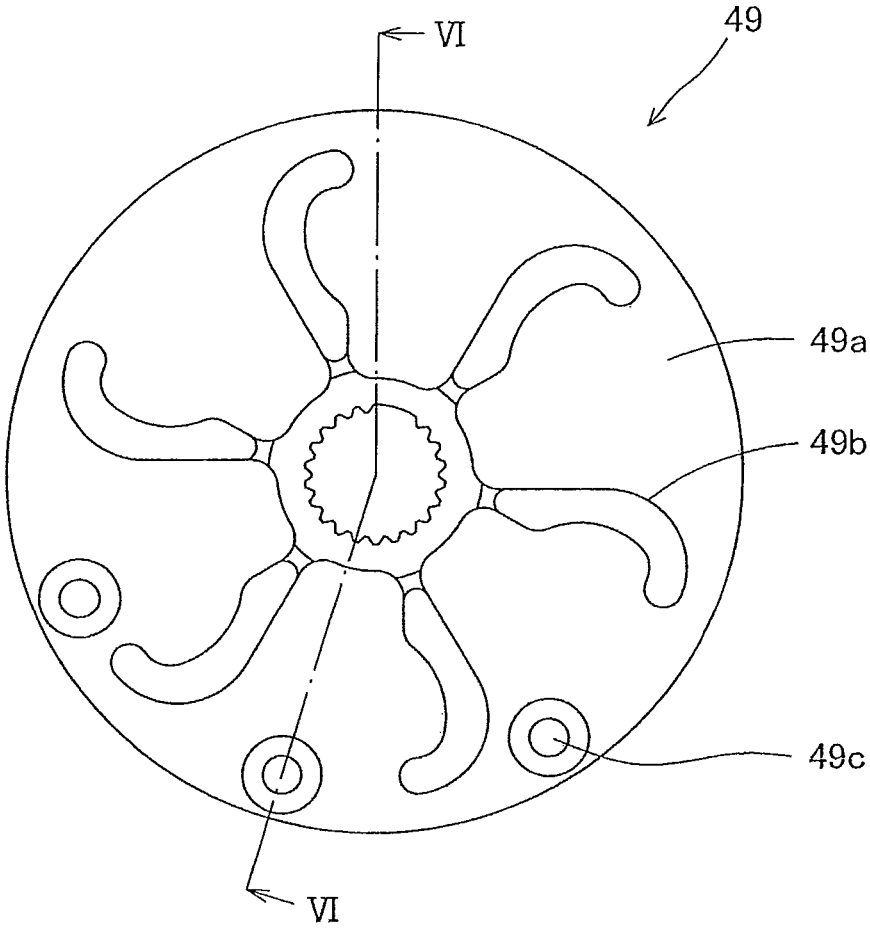
FIG. 7 is a view along arrow VII of FIG. 6.

FIG. 6 is a sectional view of the driven coupler 49 attached to the front side of the first rotating shaft, shown in FIG. 5, by a bolt 55, and FIG. 7 is a view along arrow VII of FIG. 6. FIG. 6 is a sectional view taken along line VI-VI of FIG. 7. The driven coupler 49, provided on the driven side of the coupler 12, has a disc portion 49*a* and a curved projected portion 49*b* which are formed as one body. The driven coupler 49 is combined with a driving coupler 48 (FIG. 1) attached to the rear end of the crankshaft 3 through a bolt 54, and with a rubber or other elastic member 50 (FIG. 1) as a damping material mounted between the couplers, to constitute the coupling 12 (FIG. 1). The driving coupler 48 has roughly the same shape as the driven coupler 49. These couplers 48, 49 are used in the state of being opposed to each other and brought toward each other to such positions that both the couplers overlap with each other in side view, with the elastic member 50 clamped in a space formed between the opposed curved projected portions of the couplers 48, 49 (FIG. 1). The presence of the elastic member 50 relaxes impulsive driving. The driven coupler 49 is provided in its peripheral portion with screw passing holes 49*c* in which to pass screws 51 (FIG. 5) for mounting the balancer 52 to be described later.

Figure 8:
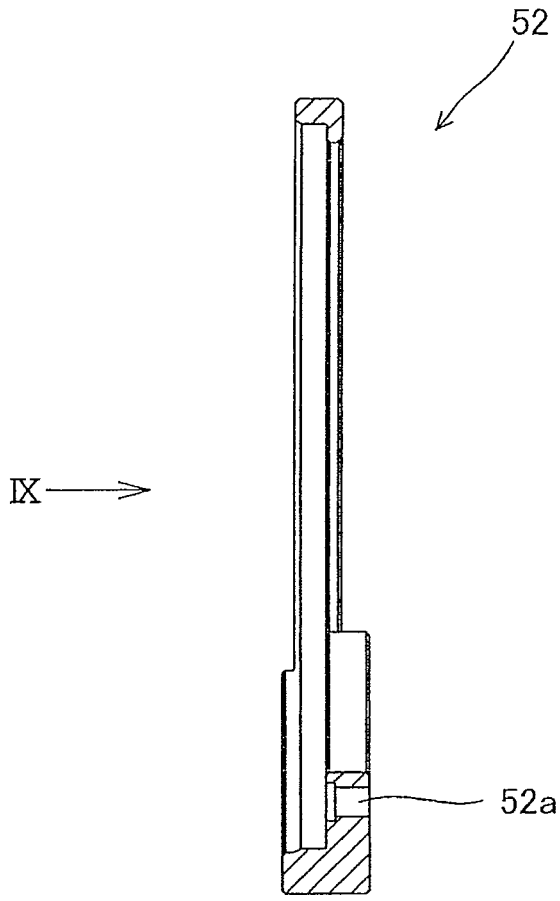
FIG. 8 is a sectional view of a balancer.
Figure 9:
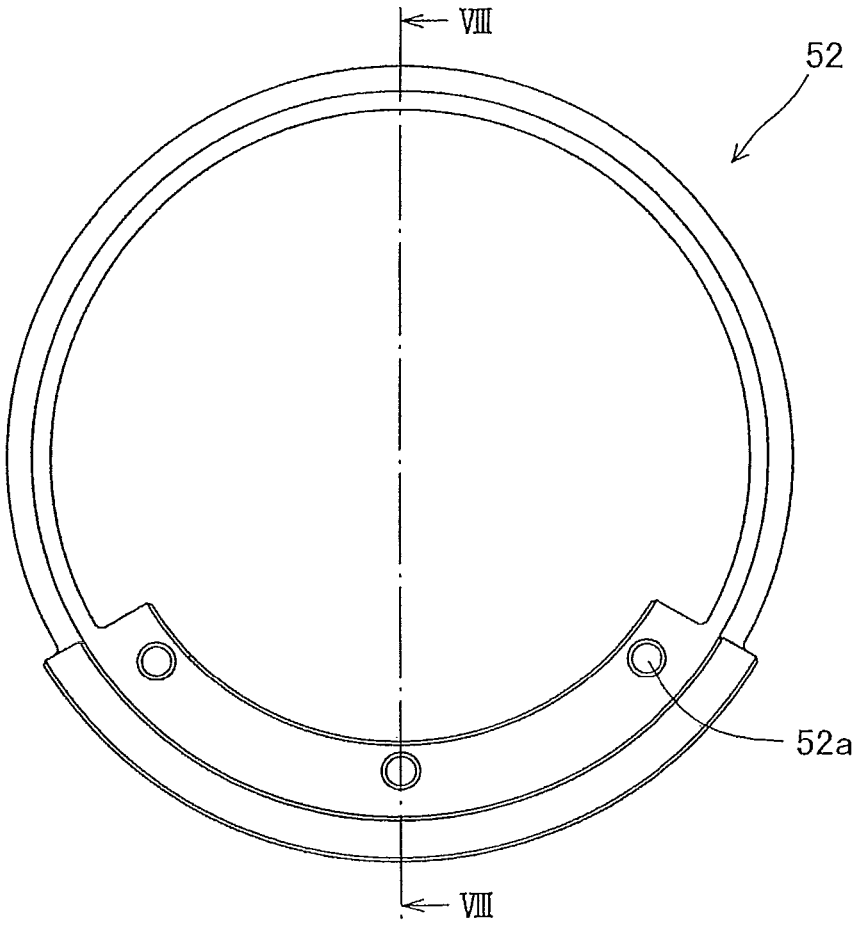
FIG. 9 is a view along arrow IX of FIG. 8.

FIG. 8 is a sectional view of the balancer 52 mounted to the disc portion 49*a* of the driven coupler 49 at the screw holes 51 (FIG. 5), and FIG. 9 is a view along arrow IX of FIG. 8. FIG. 8 is a sectional view taken along line VIII-VIII of FIG. 9. The balancer 52 is for adding a mass to the side opposite to the side of eccentricity, in order to compensate for the unbalance in mass due to the eccentric shaft portion and the orbiting scroll with respect to the rotational axis. Since the balancer 52 is disposed on the outside of the stationary scroll 17, the balancer 52 can be disposed to be spaced from the first rotating shaft 21. Further, since the balancer 52 is provided to be integral with the coupling 12, layout of the scroll compressor 1 inclusive of the balancer 52 and the coupling 12 can be made compact. In addition, the balancer 52 is formed in an annular shape, is fitted on the outer periphery of the driven coupler 49, and is fixed in situ by screw engaging the screws 51 (FIG. 5), passed through the screw passing holes 49*c* in the driven coupler 49, into the screw holes 52*a* in the balancer 52. Since the balancer 52 is fitted onto the outer periphery of the driven coupler 49 at the time of mounting, the positioning of the balancer 52 can be easily carried out.

As has been detailed above, the present embodiment yields the following effects.

Since the balancer is disposed on the outside of the stationary scroll, the balancer can be disposed to be spaced from the rotating shaft; further, since the balancer is provided to be integral with the coupling, layout of the compressor inclusive of the balancer and the coupling can be made compact.

(2) By the positioning members, thrusts of the orbiting scroll bearings can be easily restricted. Moreover, the structure in which the oil passage provided at the axis of the rotating shaft communicates with the positioning members enables easy supply of the lubricating oil to the positioning members.

(3) Positioning with respect to the coupling is facilitated, and the rotating mass of the rotating shaft can be increased.

(4) Since the eccentric shaft portion is formed therein with the lightening hole and the balancer is provided on the opposite side of the rotating shaft from the eccentric shaft portion, the rotating shaft and the balancer can be reduced in weight.

In addition, as has been detailed above, the present embodiment yields the following effects.

Since the oil passage for connection between the central oil passage in the rotating shaft and the exterior is formed by utilizing the rib formed as part of the stationary scroll, oil passages for supplying the lubricating oil to the orbiting scroll bearing and the like can be easily formed, without complicating the shape of the stationary scroll.

Since the space defined by the stationary scroll, the rotating shaft, the rotating bearing, and the oil seal provided at one side surface of the rotating bearing is utilized as an oil passage, the rotating bearing is lubricated. In addition, the rotating bearing is positioned assuredly by use of the set plate. Moreover, by the structure in which the oil seal at the other side surface of the rotating bearing is held by the set plate, leakage of the lubricating oil from the rotating bearing can be prevented using a simple configuration.

Since the central oil passage is opened at the shaft end on the side opposite to the engine connection side and the lubricating oil is supplied into the central oil passage through the shaft end opening, no centrifugal force is exerted on the lubricating oil during the supply. Therefore, the lubricating oil can be supplied into the central oil passage, without complicating the structure and at a low oil pressure.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A scroll compressor comprising:

a stationary scroll formed with a scroll wrap;

an orbiting scroll formed with a scroll wrap;

a rotating shaft for putting said orbiting scroll into an orbiting motion;

a rotating bearing for rotatably supporting said rotating shaft on said stationary scroll;

an orbiting scroll bearing provided at an eccentric shaft portion of said rotating shaft and by which a central portion of said orbiting scroll is orbitably supported; and a coupling for transmitting a torque of a driving shaft to said rotating shaft;

wherein said orbiting scroll bearing is disposed at a central portion of said rotating shaft, and said coupling is provided with a balancer, wherein positioning members for restricting an axial thrust of said orbiting scroll bearing are disposed on both sides of said orbiting scroll bearing, and an oil passage provided at an axis of said rotating shaft communicates with said positioning members.

2. The scroll compressor according to claim 1, wherein said balancer is formed in an annular shape, and is fitted on an outer periphery of said coupling.

3. The scroll compressor according to claim 2, wherein said eccentric shaft portion is provided with a lightening hole along the axial direction thereof, and said balancer is provided on the opposite side of said rotating shaft from said eccentric shaft portion.

4. The scroll compressor according to claim 1, wherein said eccentric shaft portion is provided with a lightening hole along the axial direction thereof, and said balancer is provided on the opposite side of said rotating shaft from said eccentric shaft portion.

5. A scroll compressor comprising:

a stationary scroll including a scroll wrap;

an orbiting scroll including a scroll wrap;

a rotating shaft operatively connected to said orbiting scroll for imparting an orbiting motion thereto;

a rotating bearing for rotatably supporting said rotating shaft on said stationary scroll;

an orbiting scroll bearing provided at an eccentric shaft portion of said rotating shaft and by which a central portion of said orbiting scroll is orbitably supported;

a coupling for transmitting a torque of a driving shaft to said rotating shaft, said rotating shaft including a central portion;

said orbiting scroll bearing being disposed at the central portion of said rotating shaft, and a balancer operatively connected to said coupling, wherein said eccentric shaft portion is provided with a lightening hole along the axial direction thereof, and said balancer is provided on the opposite side of said rotating shaft from said eccentric shaft portion.

6. The scroll compressor according to claim 5, wherein positioning members for restricting an axial thrust of said orbiting scroll bearing are disposed on both sides of said orbiting scroll bearing, and an oil passage provided at an axis of said rotating shaft communicates with said positioning members.

7. The scroll compressor according to claim 6, wherein said balancer is formed in an annular shape, and is fitted on an outer periphery of said coupling.

8. The scroll compressor according to claim 5, wherein said balancer is formed in an annular shape, and is fitted on an outer periphery of said coupling.

9. A scroll compressor comprising:

a stationary scroll formed with a scroll wrap;

an orbiting scroll formed with a scroll wrap;

a rotating shaft operatively connected to said orbiting scroll for imparting an orbiting motion thereto;

a rotating bearing for rotatably supporting said rotating shaft on said stationary scroll; and an orbiting scroll bearing provided at an eccentric shaft portion of said rotating shaft and by which a central portion of said orbiting scroll is orbitably supported;

wherein said stationary scroll is provided at an outside surface thereof with a rib extending radially from a support portion of said rotating bearing, and said rib is formed therein with an oil passage through which a central oil passage formed in said rotating shaft is connected to the exterior.

10. The scroll compressor according to claim 9, wherein a space surrounded by said stationary scroll, said rotating shaft, said rotating bearing interposed between said stationary scroll and said rotating shaft, and an oil seal provided at one side surface of said rotating bearing interposed between said stationary scroll and said rotating shaft, is formed, said space communicates on one side thereof with said central oil passage in said rotating shaft, said space communicates on the other side thereof with said oil passage formed in said rib of said stationary scroll, a set plate for restricting the position of said rotating bearing in an axial direction is further provided at the other side surface of said rotating bearing, and an oil seal for covering said other side surface of said rotating bearing is held by said set plate.

11. The scroll compressor according to claim 10, wherein said scroll compressor is connected to an engine;

said rotating shaft of said scroll compressor is connected to a crankshaft of said engine through a coupling;

said central oil passage in said rotating shaft opens at a shaft end on the side opposite to the engine connection side; and a lubricating oil is supplied to said shaft end opening of said central oil passage in said rotating shaft through said oil passage formed in said rib of said stationary scroll on the side opposite to the engine connection side.

12. The scroll compressor according to claim 9, wherein said scroll compressor is connected to an engine;

said rotating shaft of said scroll compressor is connected to a crankshaft of said engine through a coupling;

said central oil passage in said rotating shaft opens at a shaft end on the side opposite to the engine connection side; and a lubricating oil is supplied to said shaft end opening of said central oil passage in said rotating shaft through said oil passage formed in said rib of said stationary scroll on the side opposite to the engine connection side.

* * * * *